US006273661B1

(12) United States Patent
Payne

(10) Patent No.: US 6,273,661 B1
(45) Date of Patent: Aug. 14, 2001

(54) METHOD AND APPARATUS FOR BINDING PRINT MEDIA

(75) Inventor: David M. Payne, Meridian, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/633,917

(22) Filed: Aug. 7, 2000

(51) Int. Cl.[7] ..... B42C 9/00

(52) U.S. Cl. ..... 412/8; 156/578; 222/420; 412/9; 412/37

(58) Field of Search ..... 222/420, 421, 222/478, 481, 544; 156/145, 277, 578; 412/9, 33, 37, 8; 401/16, 17, 40, 133, 135, 137

(56) References Cited

U.S. PATENT DOCUMENTS

| | | | | |
|---|---|---|---|---|
| 4,556,353 | | 12/1985 | Ehlermann | 412/5 |
| 4,665,492 | * | 5/1987 | Masters | 264/24 |
| 4,669,661 | | 6/1987 | Otto | 239/132.1 |
| 4,975,011 | | 12/1990 | Holmberg | 412/6 |
| 5,129,356 | | 7/1992 | Bandy et al. | 118/315 |
| 5,194,299 | * | 3/1993 | Fry | 427/421 |
| 5,605,575 | * | 2/1997 | Anderson | 412/11 |
| 5,632,853 | * | 5/1997 | Montandon, Jr. et al. | 412/37 |
| 5,634,758 | * | 6/1997 | Leu | 412/8 |
| 5,720,850 | | 2/1998 | Otten | 156/578 |
| 5,759,171 | | 6/1998 | Coelho et al. | 604/82 |
| 6,074,048 | * | 6/2000 | Hotomi et al. | 347/71 |
| 6,165,406 | * | 12/2000 | Jang et al. | 264/308 |

* cited by examiner

*Primary Examiner*—A. L. Wellington
*Assistant Examiner*—Monica Carter

(57) ABSTRACT

A method and apparatus for binding sheet print media uses a cartridge adapted from ink-jet technology for selectively firing droplets of adhesive onto an adjacently positioned stack of printed sheets.

4 Claims, 3 Drawing Sheets

METHOD AND APPARATUS FOR BINDING PRINT MEDIA

FIELD OF THE INVENTION

The present invention relates generally to print media binding and more specifically to a method and apparatus for automated application of an adhesive to a stack of print media to "staple" or otherwise provide a binding of the stack.

BACKGROUND OF THE INVENTION

In any collated, multi-page output hard copy, such as from an office printer, facsimile machine, copier, scanner having an automated document feeder, or the like, the end-user often desires an automated stapling or binding of each copy.

Some copiers have a built-in stapler which the end-user loads periodically with metal staples; each copy set, if not too high a stack, is manually aligned and inserted at one corner and the staple is electromechanically driven through the inserted edge or corner. Many high-priced, high-speed, copiers include a fully automated stapling-device, also using metal staples, in conjunction with an automated collator provided for collating and stacking the output. Each of such known apparatus are limited in the type and the position of binding of the copy set.

Adhesive-type binding has also been used to bind sheet media. U.S. Pat. No. 4,975,001 (Holmberg) proposes a prefabricated bindable sheet, with a solvent-activated adhesive on an edge. U.S. Pat. No. 5,129,356 (Bandy et al.) proposes a pivot-head fluid applicator useful in painting glue strips on web material. Gun-type glue sprayers are often used in medical applications; see e.g., U.S. Pat. No. 5,759,171 (Coelho et al.). Hot melt glue guns are also known in the art; see e.g., U.S. Pat. No. 4,669,661 (Otto). Roll-on application of glue for binding books is also known in the art; see e.g., U.S. Pat. No. 4,556,353 (Ehlermann).

None of the prior art solutions provides a simple method nor apparatus for forming a "liquid staple" in a printer output. There is a need for a more flexible print media binding method and apparatus in a printed stack or copy set output. (The term "copy set" is used hereinafter to designate any stack of two or more sheets output, whether from a printer, facsimile machine, copier, scanner, or the like; no limitation on the scope of the invention is intended by the inventor nor should any be implied.)

SUMMARY OF THE INVENTION

In one aspect, the present invention provides a device for binding a stack of sheet print media including: a cartridge having a plurality of nozzles for spraying a liquid adhesive; individually selectable drop generating devices adjacent each of said nozzles; and electrical controls for selectively firing drops of adhesive from each of said nozzles.

In another aspect, the present invention provides for a a method for binding a stack of sheet print media output by a hard copy printing apparatus, including steps of: collating and aligning a stack of output sheets; determining at least one position for binding the stack; firing a plurality of individual drops of glue from an ink-jet pen adapted for containing and firing droplets of said glue and thereby forming a predetermined adhesive binding at said at least one position.

In another aspect, the present invention provides a hard copy apparatus having an output means for collating and aligning sheet print media into a stack having a height dimension, including: a glue-jetting mechanism having a self-contained supply of liquid adhesive and a plurality of individually selectable set of nozzles; a controller for coordinating jetting of drops of glue from selected nozzles onto said stack based on said height dimension.

In yet another aspect, the present invention provides a glue jetting device including: a glue containment housing; a supply of glue within the housing; a thermal printhead mounted to the housing and fluidically coupled to the supply of glue; and a connector for transmitting control signals to said thermal printhead.

Some of the advantages of the present invention are:

- it provides end-user selectively in the position of binding a copy set;
- it can provide a liquid staple that can be removed without leaving holes in the print media;
- it provides ability to bind relatively large copy sets;
- it allows more than just single point binding;
- it is adaptable to a wide variety of implementations;
- it is a low cost solution to a wide variety of binding problems; and
- it can conform to a wide variety of types of copy sets.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01 (d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DETAILED DESCRIPTION OF THE INVENTION

Reference is made now in detail to a specific embodiment of the present invention, which illustrates the best mode presently contemplated by the inventor for practicing the invention. Alternative embodiments are also briefly described as applicable.

Figure 1:
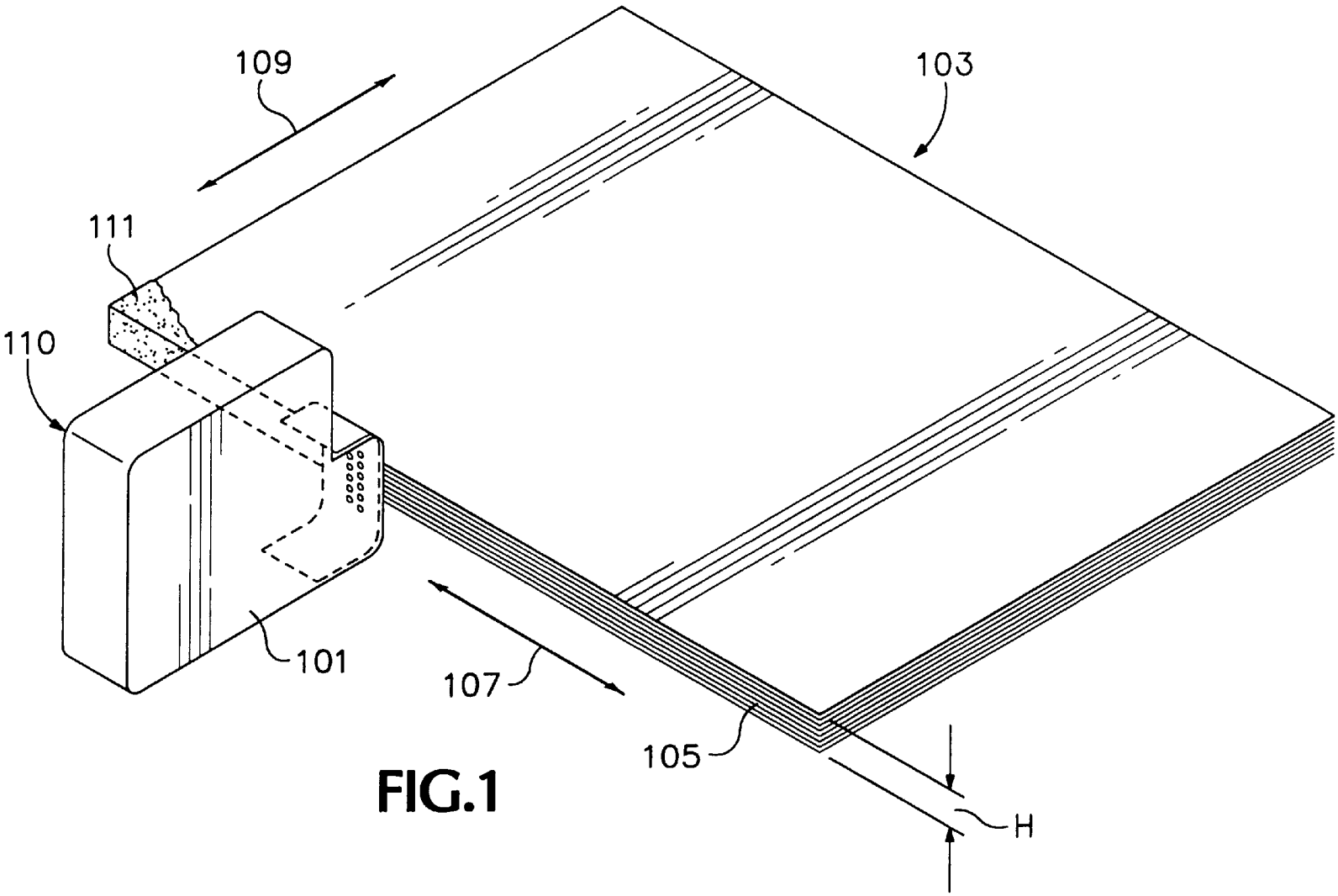
FIG. 1 is a schematic drawing of a first embodiment of the present invention.
Figure 2:
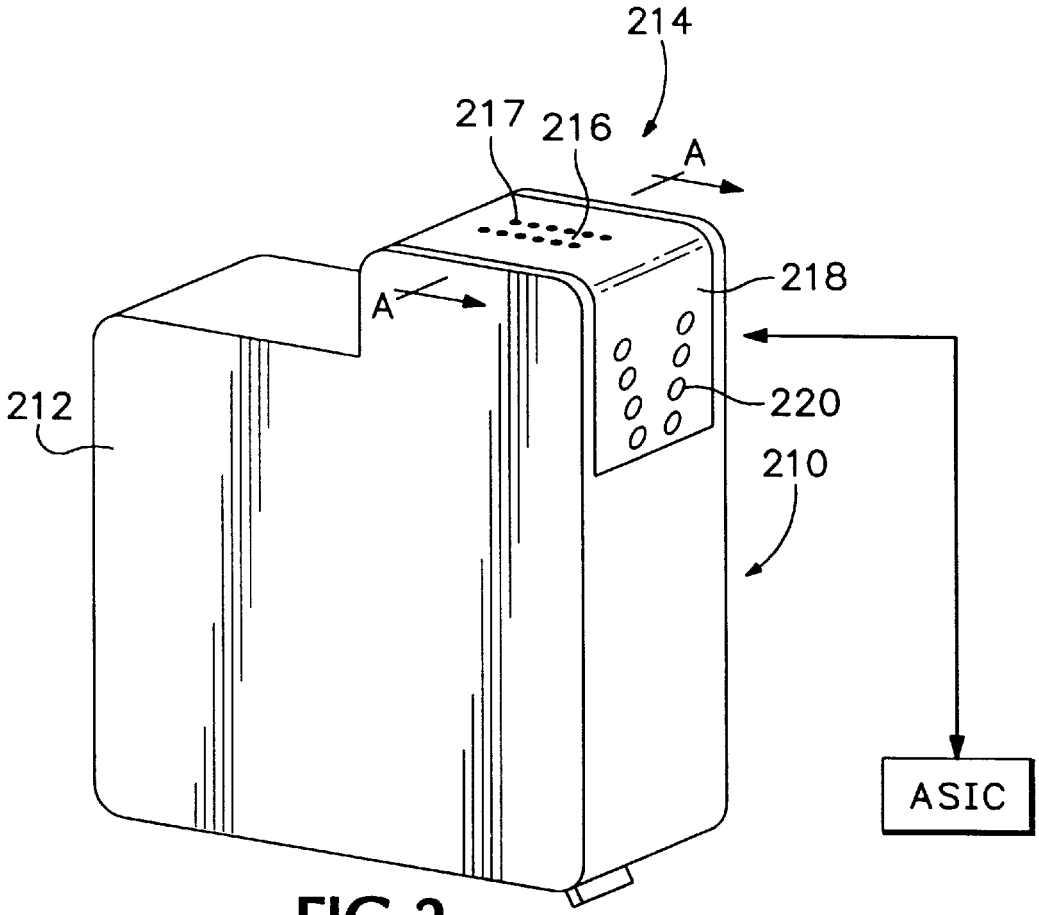
FIG.2 (PRIOR ART)
FIG. 2 (Prior Art) is a perspective view of an ink-jet print cartridge.
Figure 2A:
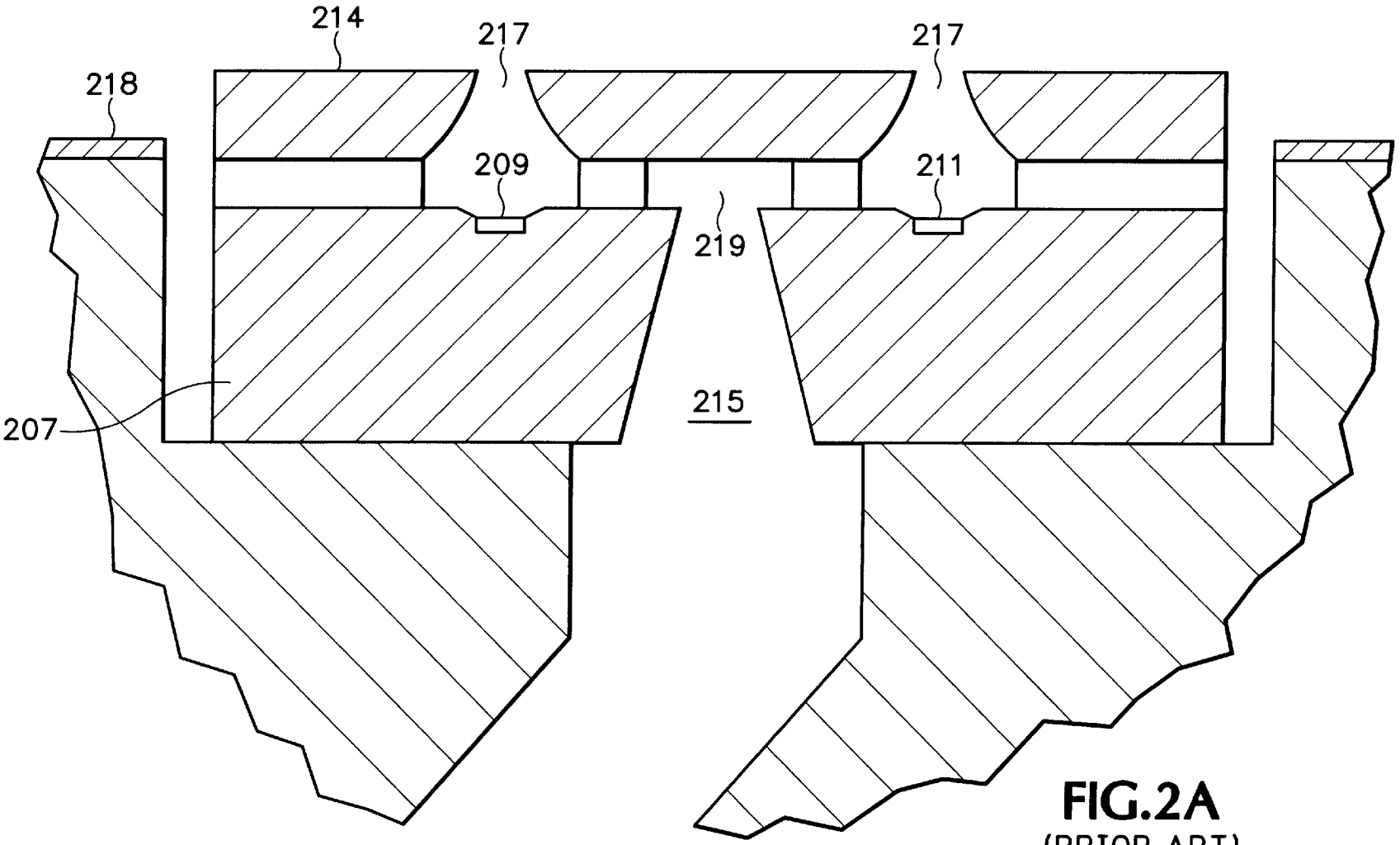
FIG.2A (PRIOR ART)
FIG. 2A is a sectional detail of a printhead of the cartridge shown in FIG. 2, taken in plane A—A.

FIG. 1 is a schematic illustration, demonstrating the present invention. In accordance with the present invention, a ink-jet print cartridge is employed. A simplistic schematic of a swath-scanning ink-jet print cartridge, or "pen," 210 is shown in FIG. 2 (PRIOR ART). The body 212 of the pen 210 generally contains a chamber that usually stores and regulates the flow of ink. A printhead 214 element includes an appropriate electrical connector 218 (such as a tape automated bonding flex tape) used for transmitting signals to and from the printhead via electrical connections 220. Columns of nozzles 217 form an addressable firing array 216. The nozzle array 205 is usually subdivided into discrete subsets, known as "primitives," which are dedicated to firing droplets of specific colorants for full color printing. Referring to FIG. 2A, a cross-section in plane A—A of the printhead of FIG. 2, ink is supplied to the printhead 214 by way of a common ink-plenum 215 and through a slot 219 in a printhead substrate 207. In a thermal inkjet pen, each drop generator mechanism includes a heater resistor 209, 21 1 subjacent each nozzle 217 which superheats ink to a cavitation point such that an ink bubble's expansion and collapse ejects a droplet from the associated nozzle. In commercially available products, piezoelectric and wave generating element techniques are also used to fire the ink drops. Such pens are scanned across the media and nozzles selectively fired to form a dot matrix on adjacent print media; electronically controlled, digital manipulation of the fired drops allows the formation of alphanumeric characters and graphical images. Microprocessors and application specific integrated circuits (ASIC) are well known in the state of the art for controlling printhead firing sequences.

Returning to FIG. 1, a cartridge 110, substantially identical to the ink-jet cartridge 210 of FIG. 2 in operation, is adapted for use in the present invention by replacing the internal ink supply with a supply of liquid glue 101. A commercial glue which is fast drying upon contact in air is preferred. A commercial glue such as type 2000NF by 3M Company of Minnesota may be employed. In general, an empirical determination can be made as to the best glue suited for a specific implementation, depending on the operating characteristics of the specific cartridge employed or adapted for the present invention functionality. A glue which can be removed, such as by rubbing or pealing without damaging paper of a copy set is preferred. Hereinafter the cartridge 110 is referred to as a "glue-jet cartridge." The term "glue" is intentionally used synonymously with any bonding agent which can be adapted for use with the disclosed invention; no limitation on the scope of the invention is intended by the inventor nor should any be implied therefrom.

An output stack 103 of sheet print media 105 from a hard copy printer (not shown) is collated with the edges aligned for binding in any known manner. U.S. Pat. Nos. 5,466,079 (Quintana), 5,511,770 (Okazaki), 5,564,848 (Quintana), 5,574,551 (Kazakoff), and 5,624,196 (Jackson et al.) exemplify such print media position detecting and handling apparatus (each assigned to the common assignee herein and incorporated herein by reference).

The glue-jet cartridge 110 is adapted for applying droplets of glue on command onto an adjacently positioned stack 103. The cartridge can be mounted in a known manner for translation along one or two edges of the stack 103 is represented by arrows 107, 109. See e.g. U.S. Pat. No. 4,786,803 by Majette et al. for a Single Channel Encoder with Specific Scale Support Structure as demonstrating the positioning and tracking of a translational ink-jet cartridge (assigned to the common assignee herein and incorporated herein by reference).

The stack height, "H," is determined, such as by commercially available inductive sensors, capacitive sensors, mechanical interference sensors, optical sensors, load sensors, or the like as would be known in the art.

Positioning of the binding is selected or set to a default. For example, in FIG. 2 a "liquid staple" 111 is formed in a predetermined corner of the stack 103 by selecting appropriate nozzles 217 (see e.g., FIG. 2) of the cartridge 110 and firing glue 101 onto the stack 103. Alternatively, a complete book-edge binding can be formed by spraying glue onto the stack 103 while translating the cartridge 110 in a manner demonstrated by arrow 107. A top edge, paper-pad binding can be formed by spraying glue from the cartridge 110 while translating in a manner demonstrated by arrow 109. Spot-binding corners or edges can similarly be performed. A plurality of such binding modes can be user selectable via a controller ASIC electrically connected to the glue-jet cartridge 110 (see e.g., FIG. 2).

It can be recognized that an alternative embodiment can be developed where a single cartridge is compartmentalized and mounted such that both the ink-jet printing and post-printing binding of multiple sheets can be performed by the same "pen." Certain primitives would be used for ink-jetting and another primitive would be used for glue-jetting.

The present invention thus provides a method and apparatus for binding sheet print media uses a cartridge adapted from inkjet technology for selectively firing droplets of adhesive onto an adjacently positioned stack of printed sheets. The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. A method for binding a stack of cut sheet print media output in a hard copy printing apparatus, comprising steps of:

collating and aligning a stack of output sheets;

determining at least one position for binding the stack;

firing a plurality of individual drops of glue at said at least one position wherein said firing is from an ink-jet pen adapted for containing and firing droplets of said glue and thereby forming a predetermined adhesive binding.

2. A hard copy apparatus, having an output means for collating and aligning sheet print media into a stack having a height dimension, said apparatus comprising:

a glue-jetting mechanism having a self-contained supply of liquid adhesive and a plurality of individually selectable set of nozzles;

a controller for coordinating jetting of drops of glue from selected nozzles onto said stack based on said height dimension.

3. The apparatus as set forth in claim 2, comprising:

said controller providing a plurality of modes for binding said stack.

4. The apparatus as set forth in claim 2, comprising:

said glue-jetting mechanism is an ink-jet cartridge having at least one primitive adapted for using at least said liquid adhesive.

* * * * *